US005320080A

United States Patent [19]

Kadowaki

[11] Patent Number: 5,320,080

[45] Date of Patent: Jun. 14, 1994

[54] LEAN BURN CONTROL SYSTEM FOR INTERNAL COMBUSTION ENGINE

[75] Inventor: Hisashi Kadowaki, Kariya, Japan

[73] Assignee: Nippondenso Co., Ltd., Kariya, Japan

[21] Appl. No.: 62,290

[22] Filed: May 18, 1993

[30] Foreign Application Priority Data

May 19, 1992 [JP] Japan ..... 4-126486

[51] Int. Cl.[5] ..... F02D 41/14

[52] U.S. Cl. ..... 123/674; 123/695

[58] Field of Search ..... 123/674, 675, 695

[56] References Cited

U.S. PATENT DOCUMENTS 4,653,451 3/1987 Kobayashi et al. ..... 123/41.08

4,825,838 5/1989 Osuga et al. ..... 123/695

FOREIGN PATENT DOCUMENTS 60-233334 11/1985 Japan .

*Primary Examiner*—Andrew M. Dolinar

*Attorney, Agent, or Firm*—Cushman, Darby & Cushman

[57] ABSTRACT

In a lean burn control system for an internal combustion engine, when surging in the engine is caused due to lowering of an engine lean limit, a first correction circuit decreases a target air-fuel ratio irrespective of whether the system is operated under an open loop control or a feedback control. On the other hand, when the surging is caused due to variation in output characteristic of an air-fuel ratio monitoring sensor, a second correction circuit decreases the target air-fuel ratio only when the system is operated under the feedback control. Accordingly, the target air-fuel ratio as corrected by the first correction circuit is used in the open loop control, while the target air-fuel ratio as corrected by the first and second correction circuits is used in the feedback control.

11 Claims, 6 Drawing Sheets

LEAN BURN CONTROL SYSTEM FOR INTERNAL COMBUSTION ENGINE

BACKGROUND OF THE INVENTION

1. Field of the Invention

The present invention relates generally to a lean burn control system for an internal combustion engine, and more specifically, to a lean burn control system for an internal combustion engine, wherein surging in the engine detected in a lean burn feedback control is eliminated by correcting a target air-fuel ratio of an air-fuel mixture gas supplied to the engine.

2. Description of the Prior Art

A lean burn control system for an internal combustion engine is known, which controls an air-fuel ratio of the air-fuel mixture gas to a lean side with respect to the stoichiometric air-fuel ratio for improving exhaust emission and fuel consumption. In general, when the air-fuel ratio is controlled toward the lean side beyond a lean limit defined by an engine characteristic, combustion in the engine becomes unstable to cause surging. This lean limit is lowered, i.e. shifted toward a richer side, due to deterioration of the engine.

In view of this, technique has been proposed in such as U.S. Pat. No. 4,653,451, wherein the lowering of the engine lean limit is determined when the surging is detected based on outputs of a lean mixture sensor during the lean burn feedback control of the air-fuel ratio. When it is so determined, a target air-fuel ratio of the air-fuel mixture gas is decreased to a richer side.

It is to be appreciated that the surging is likely to be induced not only when the engine lean limit is lowered, but also when an output characteristic of the lean mixture sensor is changed. This change in the lean mixture sensor output characteristic is caused due to deterioration of the lean mixture sensor itself and environmental variation, such as, variation in the atmospheric pressure therearound. For example, an output level of the lean mixture sensor lowers due to the deterioration thereof or at the highlands so that the air-fuel ratio is detected to be richer than an actual value. Accordingly, the system judges the air-fuel ratio to be still on a richer side than a target air-fuel ratio even when the target air-fuel ratio has been actually reached, so as to control the air-fuel ratio more to the lean side. As a result, the air-fuel ratio is controlled to be excessively lean, leading to generation of the surging.

In the conventional system disclosed such as in the foregoing U.S. Patent, however, the surging is dealt with by decreasing the target air-fuel ratio without judging whether it is caused by the lowering of the engine lean limit or the output characteristic variation of the lean mixture sensor. As a result, since the target air-fuel ratio is corrected to be decreased even when the surging is caused by the output characteristic variation of the lean mixture sensor, when the system is shifted to an open loop control, the air-fuel ratio is controlled to be unnecessarily richer due to the continued decreasing correction of the target air-fuel ratio, leading to increment of NOx emission.

SUMMARY OF THE INVENTION

Therefore, it is an object of the present invention to provide an improved lean burn control system for an internal combustion engine that can eliminate the above-noted defects inherent in the conventional lean burn control system.

To accomplish the above-mentioned and other objects, according to one aspect of the present invention, a lean burn control system for an internal combustion engine having a first operation mode in which an air-fuel ratio of the air-fuel mixture gas is controlled by a target air-fuel ratio indicative value in an open loop control and a second operation mode in which an air-fuel ratio of the air-fuel mixture gas is controlled by a target air-fuel ratio indicative value in a feedback control, comprises means for detecting occurrence of surging in the engine in the second operation mode; means for halting the second operation mode when the surging is detected by the surging detecting means; means for determining whether the surging is lasting or stopped after the second operation mode is halted by the halting means; first updating means for updating a first correction value for the target air-fuel ratio indicative value when the determining means determines that the surging is lasting, the first updating means updating the first correction value so as to eliminate the surging detected in the second operation mode; second updating means for updating a second correction value for the target air-fuel ratio indicative value when the determining means determines that the surging is stopped, the second updating means updating the second correction value so as to eliminate the surging detected in the second operation mode; first correction means for correcting the target air-fuel ratio indicative value based on the first correction value, the first correction means correcting the target air-fuel ratio indicative value in either of the first and second operation modes; and second correction means for correcting the target air-fuel ratio indicative value based on the second correction value, the second correction means correcting the target air-fuel ratio indicative value only in the second operation mode.

According to another aspect of the present invention, a lean burn control system for an internal combustion engine comprises sensor means for monitoring a preselected component contained in exhaust gas to produce an air-fuel ratio indicative signal; means for setting a target air-fuel ratio indicative value; open loop control means for controlling an air-fuel ratio of air-fuel mixture gas to be fed to the engine based on the target air-fuel ratio indicative value in an open loop control; feedback control means for controlling an air-fuel ratio of air-fuel mixture gas to be fed to the engine based on the air-fuel ratio indicative signal and the target air-fuel ratio indicative value in a feedback control; means for detecting occurrence of surging in the engine in the feedback control; means for executing selection between the open loop control and the feedback control, the selection means halting the feedback control to select the open loop control when the surging is detected by the surging detecting means; means for determining whether the surging is lasting or stopped after the feedback control is halted by the selection means; first updating means for updating a correction value for the target air-fuel ratio indicative value when the determining means determines that the surging is lasting, the first updating means updating the correction value so as to eliminate the surging detected in the feedback control; first correction means for correcting the target air-fuel ratio indicative value based on the correction value, the first correction means correcting the target air-fuel ratio indicative value in either of the open loop control and the feedback control to provide a first corrected target air-fuel ratio indicative value; second updating means for updating a correction value for the first corrected target air-fuel ratio indicative value when the determining means determines that the surging is stopped, the second updating means updating the correction value for the first corrected target air-fuel ratio indicative value so as to eliminate the surging detected in the feedback control; and second correction means for correcting the first corrected target air-fuel ratio indicative value based on the correction value for the first corrected target air-fuel ratio indicative value, the second correction means correcting the first corrected target air-fuel ratio indicative value in the feedback control to provide a second corrected target air-fuel ratio indicative value, whereby the open loop control means controls the air-fuel ratio of the air-fuel mixture gas based on the first corrected target air-fuel ratio indicative value, while the feedback control means controls the air-fuel ratio of the air-fuel mixture gas based on the air-fuel ratio indicative signal and the second corrected target air-fuel ratio indicative value.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, a lean burn control system for an internal combustion engine according to a preferred embodiment of the present invention will be described with reference to the drawings.

Figure 1:
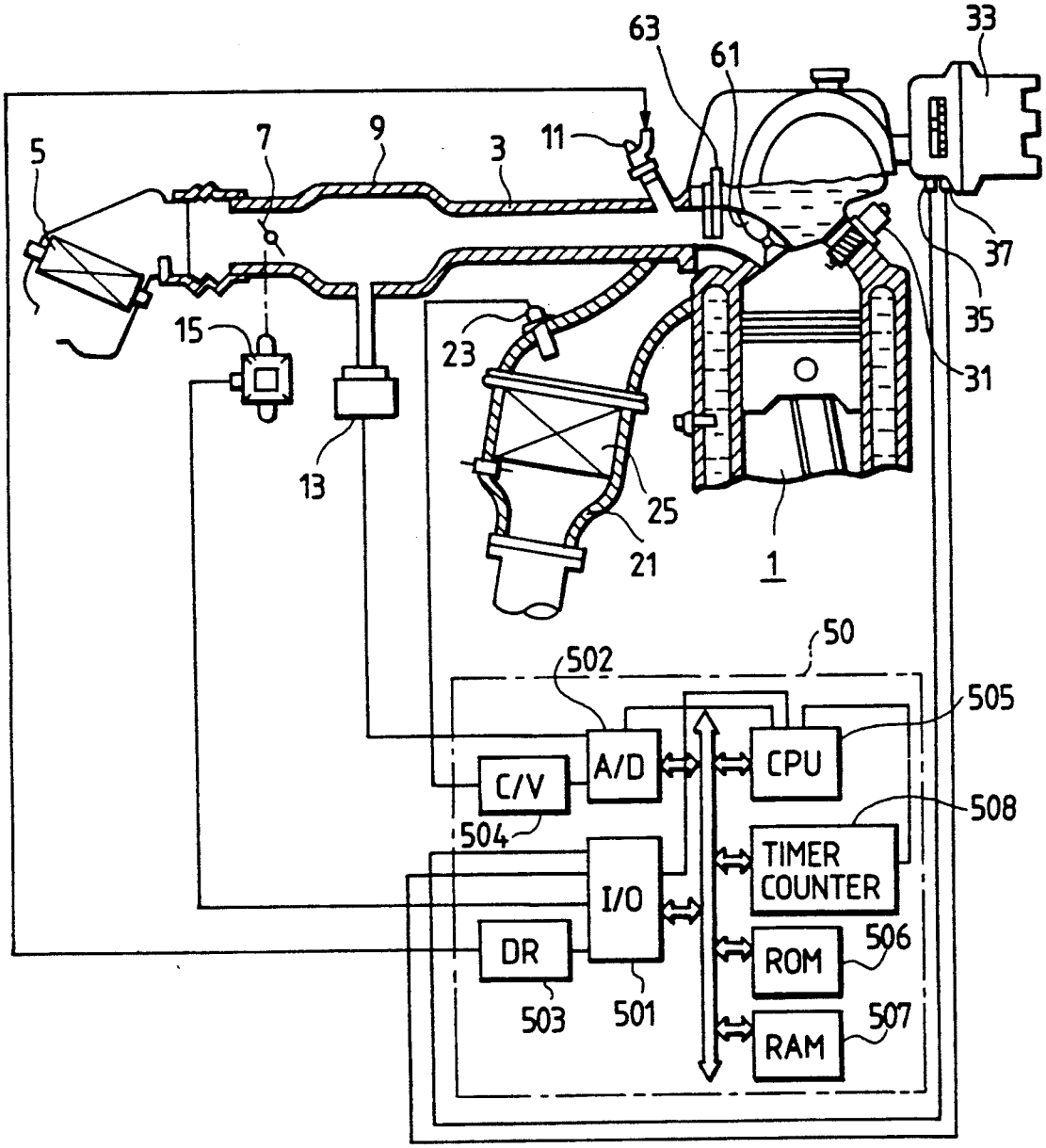
FIG. 1 is a schematic view showing an overall structure of a lean burn control system for an internal combustion engine according to a preferred embodiment of the present invention.

FIG. 1 shows the entire structure of the lean burn control system as applied to a four-cycle gasoline engine.

In FIG. 1, an intake passage 3 of the engine 1 includes, from its upstream side, an air cleaner 5 for cleaning intake air, a throttle valve 7 for regulating a flow rate of the take air passing therethrough depending on a driver's operation of an accelerator (not shown), a surge tank 9 for absorbing pressure variation of the intake air and a fuel injector 11 for each engine cylinder for injecting pressurized fuel into an intake port of the corresponding engine cylinder. In the surge tank 9, a pressure sensor 13 is disposed for detecting the absolute pressure within the surge tank 9, i.e. within the intake passage 3 downstream of the throttle valve 7 (hereinafter referred to as "intake manifold pressure"). A throttle position sensor 15 is further provided for detecting an opening degree of the throttle valve 7.

An exhaust passage 21 of the engine 1 includes therein a lean mixture sensor 23 for monitoring an oxygen concentration in the exhaust gas so as to produce a current signal indicative of an air-fuel ratio of the air-fuel mixture gas combusted in the engine 1. Since the lean mixture sensor itself is well known in the art, no further explanation thereof will be made. A catalytic converter 25 is further provided in the exhaust passage 21 for purifying the exhaust gas.

A distributor 33 distributes a high voltage generated at an igniter (not shown) to corresponding spark plugs 31 for the respective engine cylinders according to a monitored angular position of an engine crankshaft (not shown). In the distributor 33, a reference position sensor 35 and an engine speed sensor 37 are provided. The reference position sensor 35 produces a pulse signal per rotation of a rotation shaft of the distributor 33, i.e. per 720° CA (crank angle) for detecting a reference position of the engine crankshaft. On the other hand, the engine speed sensor 37 produces a pulse signal per 1/24 rotation of the rotation shaft of the distributor 33, i.e. per 30° CA for measuring an engine speed.

The pulse signals from the reference position sensor 35, the engine speed sensor 37 and the throttle position sensor 15 are supplied to an input/output (I/O) interface 501 of an electronic control unit (ECU) 50, and an analog signal from the pressure sensor 13 is supplied to an analog-to-digital (A/D) converter 502 of the ECU 50. The ECU 50 performs the known speed density type fuel injection control based on these input signals in this preferred embodiment. Specifically, the ECU 50 calculates an intake air flow rate supplied to the engine based on an engine speed determined by the input signal from the engine speed sensor 37 and the intake manifold pressure determined by the input signal from the pressure sensor 13. The ECU 50 further calculates a fuel injection amount such that an air-fuel ratio of the air-fuel mixture gas fed to the engine coincides with a target air-fuel ratio. The ECU 50 outputs a valve opening signal indicative of a valve opening time to each fuel injector 11 via the I/O interface 501 and a drive circuit 503 so as to realize the calculated fuel injection amount. An output timing of the valve opening signal is determined based on the signals from such as the reference position sensor 35 and the engine speed sensor 37.

An output of the lean mixture sensor 23 in the form of a current signal is converted to a voltage signal via a current-to-voltage converter 504 of the ECU 50, and then supplied to the A/D converter 502.

A swirl control valve 63 is provided upstream of an intake valve 61 to generate swirls in the air-fuel mixture gas introduced into the engine cylinder for improving the combustion state therein.

The ECU 50 is formed as a microcomputer having such as a CPU 505, a ROM 506, a RAM 507 and a timer counter 508 in addition to the above-noted I/O interface 501, A/D converter 502, drive circuit 503 and current-to-voltage converter 504.

Figure 2:
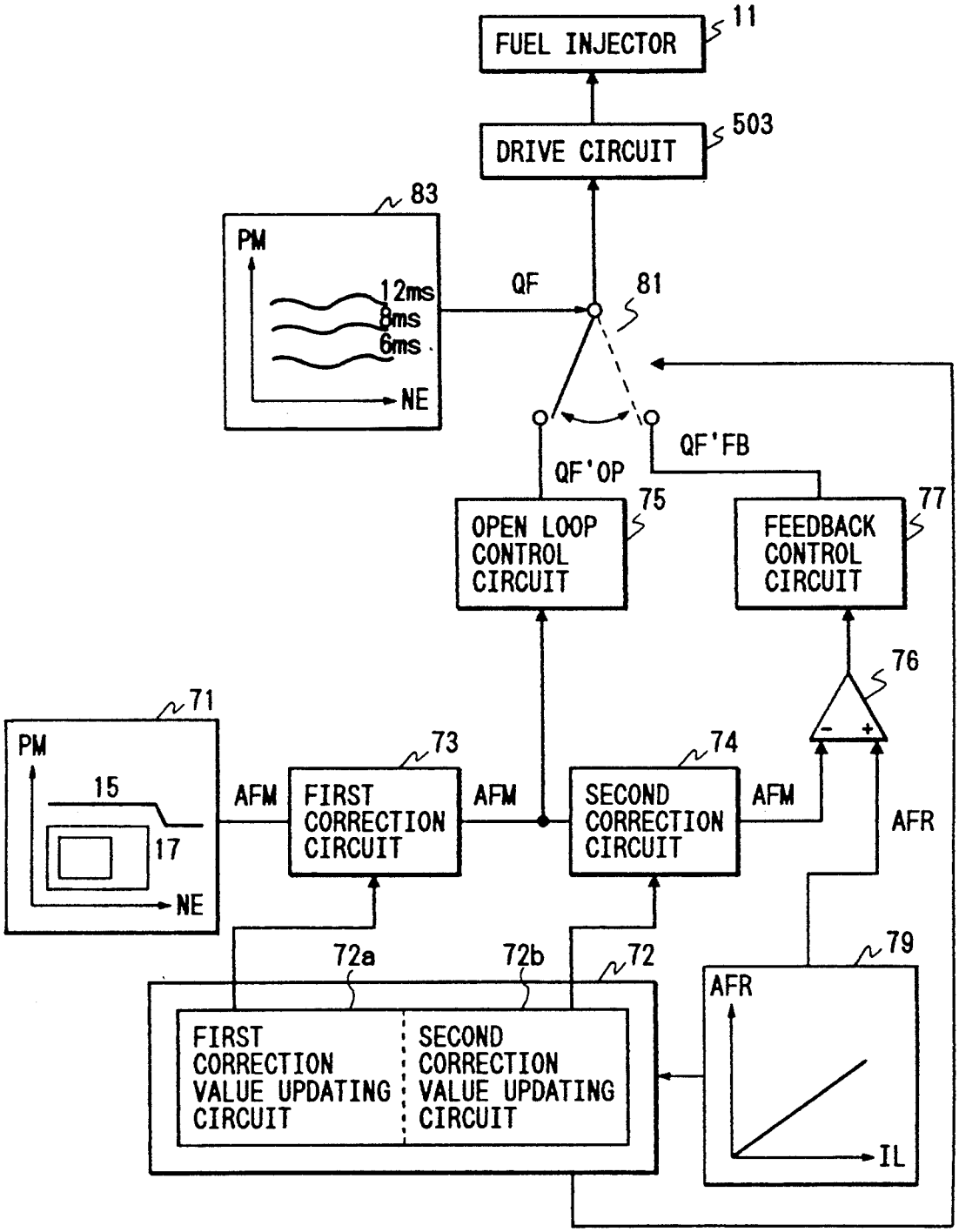
FIG. 2 is a conceptual block diagram for explaining operation of the lean burn control system according to the preferred embodiment of the present invention.

FIG. 2 shows a conceptual block diagram of the lean burn control performed in this preferred embodiment.

In the lean burn control of FIG. 2, a target air-fuel ratio AFM is determined in terms of an engine speed NE detected by the engine speed sensor 37 and an intake manifold pressure PM detected by the pressure sensor 13, using a characteristic map 71. The characteristic map 71 is defined in terms of the engine speed NE on the axis of abscissas and the intake manifold pressure PM on the axis of ordinates, and prestored in the ROM 506. The target air-fuel ratio AFM determined by the characteristic map 71 is fed to an open loop control circuit 75 via a first correction circuit 73. On the other hand, the target air-fuel ratio AFM determined by the characteristic map 71 is fed to a comparator circuit 76 via the first correction circuit 73 and a second correction circuit 74. A target air-fuel ratio correction value updating circuit 72 includes a first correction value updating circuit **72*a* and a second correction value updating circuit 72*b*. The first correction value updating circuit 72*a* updates a first correction value for the target air-fuel ratio AFM and supplies it to the first correction circuit 73. The first correction circuit 73 corrects the target air-fuel ratio AFM based on the first correction value fed from the first correction value updating circuit 72*a*, and supplies the corrected target air-fuel ratio AFM to the open loop control circuit 75 and to the second correction circuit 74. The second correction value updating circuit 72*b* updates a second correction value for the target air-fuel ratio AFM and supplies it to the second correction circuit 74. The second correction circuit 74 corrects the target air-fuel ratio AFM fed from the first correction circuit 73 based on the second correction value fed from the second correction value updating circuit 72*b*, and supplies the corrected target air-fuel ratio AFM to the comparator circuit 76. The operations of the first and second correction value updating circuits 72*a* and 72*b*, the first correction circuit 73 and the second correction circuit 74** will be described later in detail.

The open loop control circuit 75 derives a fuel injection amount correction value QF'OP based on the inputted target air-fuel ratio AFM. On the other hand, the comparator circuit 76 compares the inputted target air-fuel ratio AFM and an air-fuel ratio AFR of the air-fuel mixture gas monitored by the lean mixture sensor 23 (hereinafter also referred to as "monitored air-fuel ratio" or "actual air-fuel ratio") and outputs the comparison result to a feedback control circuit 77. The feedback control circuit 77 derives a fuel injection amount correction value QF'FB based on the inputted comparison result such that the monitored air-fuel ratio AFR coincides with the target air-fuel ratio AFM.

The relationship between an output signal IL of the lean mixture sensor 23 and an actual air-fuel ratio AFR is defined in a characteristic map 79 which has been derived through experiments and is prestored in the ROM 506. The output signal IL of the lean mixture sensor 23 practically represents a voltage value in the characteristic map 79 since the output of the lean mixture sensor 23 is converted to a voltage signal via the current-to-voltage converter 504 in this preferred embodiment as described above. It may be arranged, however, that the output signal IL in the characteristic map 79 represents a current value.

The fuel injection amount correction value QF'OP outputted from the open loop control circuit 75 or the fuel injection amount correction value QF'FB outputted from the feedback control circuit 77 is added to a basic fuel injection amount QF via a switching circuit 81 to form a valve opening signal indicative of a total fuel injection amount which is then supplied to the fuel injector 11 via the drive circuit 503 to control the operation of the fuel injector 11. The basic fuel injection amount QF is defined in a characteristic map 83 prestored in the ROM 506 and is accessible in terms of an engine speed NE and a intake manifold pressure PM. The characteristic maps 71, 79 and 83 are respectively set in the RAM 507 on the engine start-up.

The switching circuit 81 connects the feedback control circuit 77 to the drive circuit 503 when predetermined conditions for the feedback control are satisfied, and connects the open loop control circuit 75 to the drive circuit 503 otherwise.

Since the lean burn control in FIG. 2 is known in the art except for the operations of the first and second correction value updating circuits **72*a* and 72*b* and the first and second correction circuits 73 and 74**, the following explanation will be made mainly to the operations of these circuits.

Figure 3:
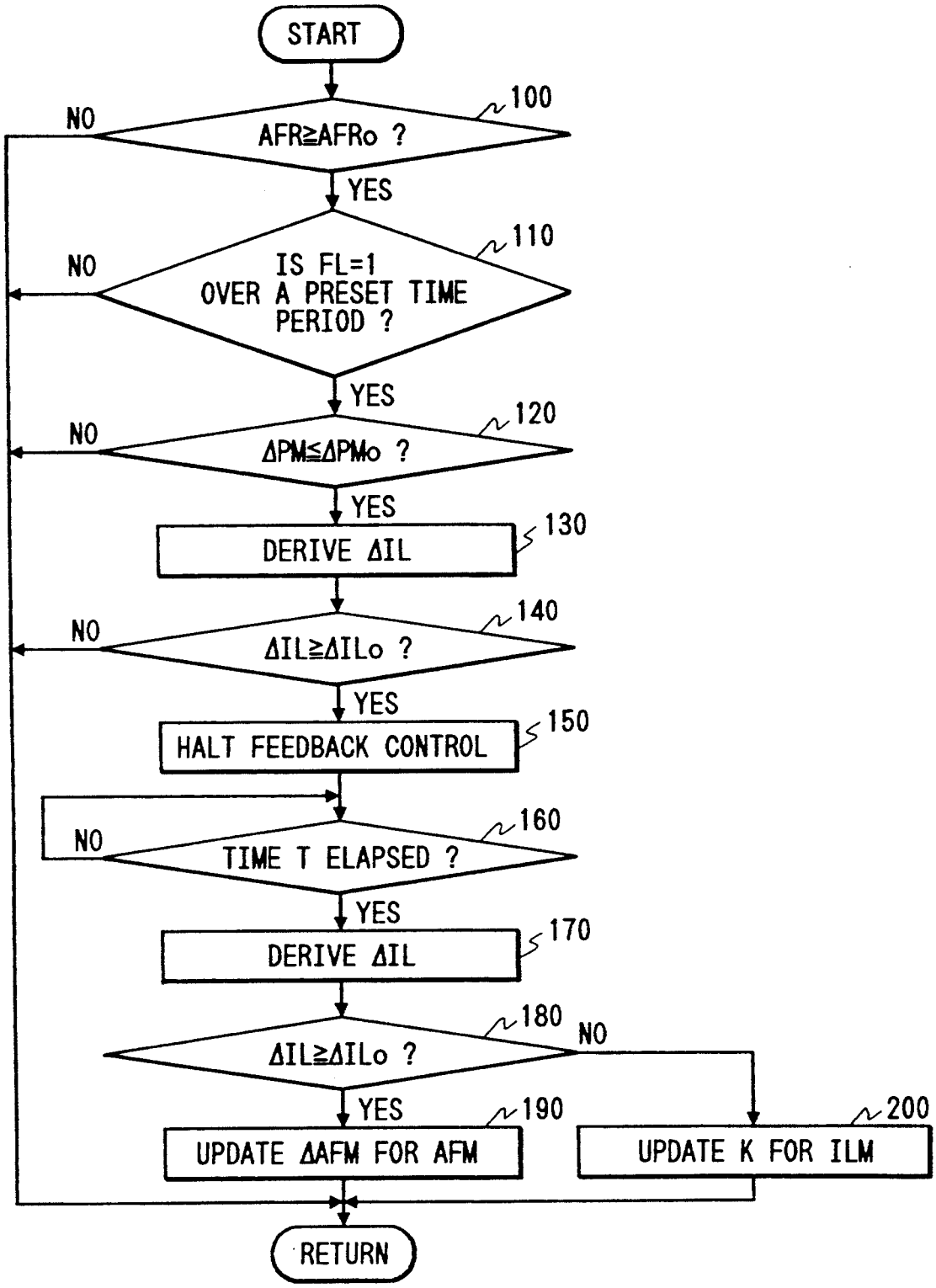
FIG. 3 is a flowchart of an interrupt routine to be executed by an electronic control unit for updating first and second correction values according to the preferred embodiment of the present invention.

FIG. 3 shows a flowchart of an interrupt routine to be executed by the ECU 50 at every given timing for updating the above-noted first or second correction value for the target air-fuel ratio AFM.

At a first step 100, it is determined whether a monitored air-fuel ratio AFR is equal to or greater than a preset threshold value AFRo. This means that the step 100 determines whether the lean burn control is executed with the air-fuel mixture gas which is leaner than a predetermined condition since the following steps are executed to update the first or second target air-fuel ratio correction value for eliminating the surging generated in the engine during the lean burn control.

When answer at the step 100 is NO, then the routine proceeds to RETURN to terminate this interrupt routine. On the other hand, when answer at the step 100 is YES, the routine proceeds to a step 110 which checks whether a lean burn feedback control flag FL is set to 1 over a predetermined time period. The lean burn feedback control flag FL is set to 1 while the switching circuit 81 connects the feedback control circuit 77 to the drive circuit 503 in FIG. 2, and reset to 0 while the switching circuit 81 connects the open loop control circuit 75 to the drive circuit 503 in FIG. 2. The step 110 is provided for executing the following steps with the lean mixture sensor 23 being fully activated.

When answer at the step 110 is NO, then the routine proceeds to RETURN to terminate this interrupt routine. On the other hand, when answer at the step 110 is YES, the routine goes to a step 120 which determines whether the engine is operating in a steady state. Specifically, the step 120 determines whether a variation Δ PM of the intake manifold pressure PM is equal to or smaller than a preset threshold value Δ PMo. The step 120 is provided for minimizing a possibility of misjudging occurrence of the surging in the following steps since an air-fuel ratio of the air-fuel mixture gas tends to fluctuate when the intake manifold pressure variation Δ PM is larger than the predetermined value, i.e. during a transitional engine operating condition, such as, the engine acceleration or deceleration. The steady state of the engine may be detected based on throttle valve opening degree data from a linear throttle position sensor by comparing a monitored throttle valve opening degree variation with a preset threshold value.

When answer at the step 120 is NO, then the routine goes to RETURN to terminate this interrupt routine. On the other hand, when answer at the step 120 is YES, the routine proceeds to a step 130 by determining that a surging determining condition has been established. At the step 130, a cumulative variation value ΔIL is derived by accumulating variation amounts of the output signals IL from the lean mixture sensor 23 during a predetermined time period. Subsequently, at a step 140, it is determined whether the cumulative variation value Δ IL is equal to or greater than a preset threshold value Δ ILo, i.e. whether or not the surging is generated.

Figure 4:
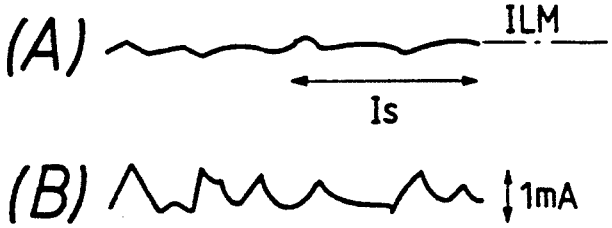
FIG. 4(A) is an explanatory view showing an output signal of a lean mixture sensor when no surging is generated.
FIG. 4(B) is an explanatory view showing an output signal of the lean mixture sensor when the surging is generated.

Specifically, when the air-fuel ratio of the air-fuel mixture gas is controlled in the lean burn feedback control satisfying the positive conditions for the steps 100 to 120, the output signal IL of the lean mixture sensor 23 is normally relatively stable with respect to a target output value ILM corresponding to the target air-fuel ratio, as shown in FIG. 4(A). On the other hand, when the surging is generated, since the combustion in the engine is unstable to lead to a large fluctuation of the oxygen concentration in the exhaust gas, the output signal IL of the lean mixture sensor 23 largely fluctuates as shown in FIG. 4(B). Accordingly, when the cumulative variation value Δ IL is equal to or greater than the preset threshold value Δ ILo, it can be determined that the surging is generated.

Figure 5:
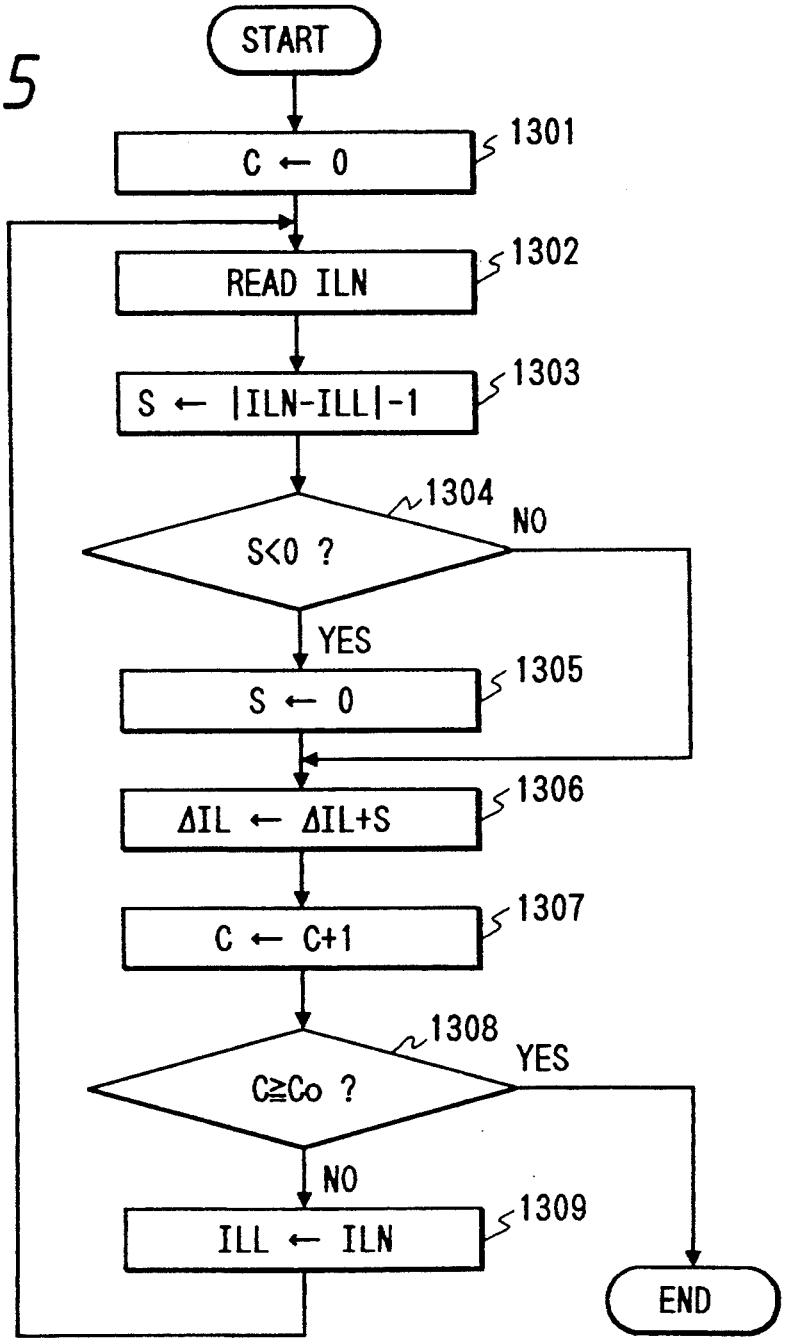
FIG. 5 is a flowchart showing a subroutine of the interrupt routine in FIG. 3, for deriving a cumulative variation value which is used for judging whether the surging is generated.

Details of the process executed at the step 130 will be described with reference to FIG. 5. FIG. 5 shows a flowchart of a subroutine for deriving the cumulative variation value Δ IL.

At a first step 1301, a counter C is reset to 0. The counter C is used for accumulating the variation amounts of the output signals of the lean mixture sensor 23 over a predetermined time period to derive the cumulative variation value Δ IL, so as to avoid misjudgment of occurrence of the surging due to a sudden large output variation caused by an instantaneous factor such as a noise.

Subsequently, the routine proceeds to a step 1302 where a current output value ILN of the lean mixture sensor 23 is read in. Thereafter, a step 1303 derives a value S by subtracting a value "1" from an absolute value between the current output value ILN and a last output value ILL of the lean mixture sensor 23. In the first cycle of this subroutine, a target output value corresponding to a target air-fuel ratio AFM is set as the last output value ILL. The routine now goes to a step 1304 which determines whether the value S derived at the step 1303 is less than a value "0". When answer at the step 1304 is YES, i.e. when the value S is a negative value, the routine proceeds to a step 1305 where the value S is set to a value "0", and then to a step 1306. On the other hand, when answer at the step 1304 is NO, the routine directly proceeds to the step 1306. At the step 1306, the value S is added to its cumulative value Δ IL. The steps 1303 to 1305 are provided for deriving the value S which is free of the noise in the output signal of the lean mixture sensor 23.

At a subsequent step 1307, the counter C is incremented by a value "1". Then, at a step 1308, it is determined whether a value of the counter C is equal to or greater than a preset value Co. When answer at the step 1308 is NO, the current output value ILN is set to a last output value ILL at a step 1309, and the steps 1302 through 1309 are repeated until answer at the step 1308 becomes YES. When answer at the step 1308 becomes YES, the routine proceeds to the step 140 in FIG. 3.

When answer at the step 140 is NO, i.e. the cumulative variation value Δ IL derived in the subroutine of FIG. 5 is less than the preset threshold value Δ ILo, the routine goes to RETURN to terminate this interrupt routine. On the other hand, when answer at the step 140 is YES, the routine proceeds to a step 150 where the lean burn feedback control is halted. This means that the switching circuit 81 is switched to connect the open loop control circuit 75 to the drive circuit 503 in FIG. 2.

Subsequently, a step 160 determines whether a preset time T has elapsed. The step 160 is repeated until the preset time T has elapsed. The time T has a duration which corresponds to a time required for the open loop control to become stable after switching from the feedback control. When answer the step 160 becomes YES, the routine proceeds to a step 170 and then to a step 180. The steps 170 and 180 just correspond to the steps 130 and 140, respectively. Specifically, the steps 170 and 180 are provided for determining whether the surging detected at the steps 130 and 140 is lasting or stopped after having shifted to the open loop control from the feedback control.

When answer at the step 180 is YES, i.e. the surging is still lasting after having shifted to the open loop control, the routine proceeds to a step 190 where a first correction value Δ AFM for the target air-fuel ratio AFM is updated. Referring to FIG. 2, the first correction value Δ AFM is updated by the first correction value updating circuit 72*a*. Further, in FIG. 2, the first correction circuit 73 derives a corrected target air-fuel ratio AFM by subtracting the first correction value Δ AFM from the target air-fuel ratio AFM determined by the characteristic map 71 as expressed by the following equation:

$$AFM \leftarrow AFM - \Delta AFM$$

Specifically, when answer at the step 180 is YES, it is determined that the surging detected at the steps 140 and 180 is caused due to the lowering of a lean limit or a surging limit of the engine 1. Accordingly, the first correction circuit 73 corrects the target air-fuel ratio AFM by the first correction value Δ AFM irrespective of whether the lean burn control is performed under the open loop control or the feedback control. The first correction circuit 73 outputs the corrected target air-fuel ratio AFM to the open loop control circuit 75 and the second correction circuit 74. Practically, the process executed in the first correction circuit 73 is executed by a main routine (not shown) for setting a fuel injection amount to be injected from the fuel injector 11.

Figure 6A:
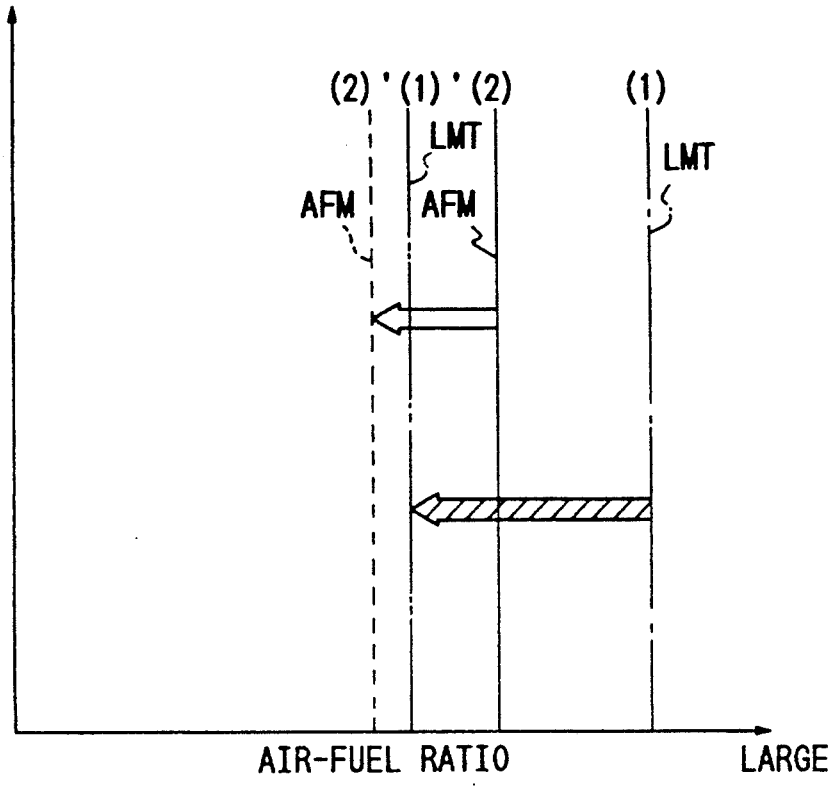
FIG. 6(A) is an explanatory view for showing relation between lowering of an engine lean limit and correction of a target air-fuel ratio.
Figure 6B:
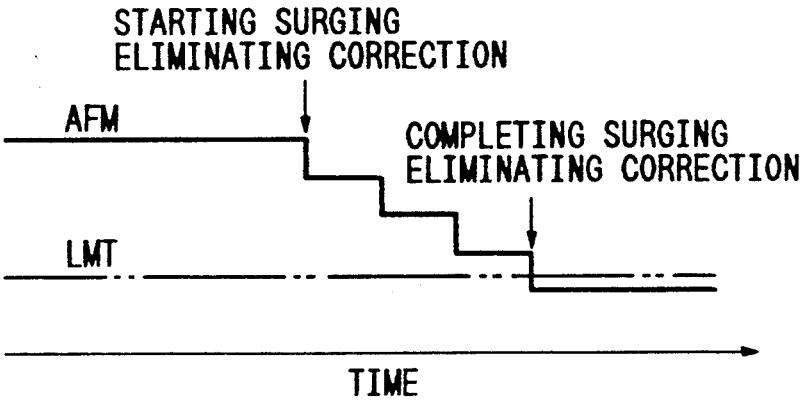
FIG. 6(B) is an explanatory view for showing a manner of the correction of the target air-fuel ratio.

The first correction value Δ AFM is initially set to a value "0", and then updated to increase stepwise by a predetermined relatively small unit value every time the step 190 is executed as shown in FIG. 6(B) until answer at the step 140 becomes NO, i.e. until the target air-fuel ratio AFM is decreased below a lowered engine lean limit LMT in FIG. 6(B). This stepwise correction of the target air-fuel ratio by the predetermined small value is required for preventing the corrected target air-fuel ratio from exceeding the lowered engine lean limit largely toward the rich side. Specifically, the lowering of the engine lean limit is caused by various factors, for example, deterioration of the engine itself and environmental variation such as temperature variation, humidity variation and atmospheric pressure variation, so that it is uncertain to what extent the engine lean limit is lowered. In light of this, the above-noted stepwise correction of the target air-fuel ratio is required to prevent the unnecessarily enriching correction. As appreciated, the first correction value Δ AFM updated at the step 190 is fixed until it is updated in a next execution of the step 190.

As shown in FIG. 6(A), when the engine lean limit LMT is lowered from a line (1) to a line (1)', the target air-fuel ratio AFM is corrected from a line (2) to a line (2)' so that the surging is effectively eliminated.

Referring back to FIG. 3, when answer at the step 180 is NO, i.e. the surging detected at the step 140 is stopped after having shifted to the open loop control, the routine proceeds to a step 200 where a second correction value K for the target air-fuel ratio AFM is updated. Specifically, being different from the first correction value Δ AFM updated at the step 190, the second correction value K is a coefficient for a target output value ILM of the lean mixture sensor 23 which corresponds to the target air-fuel ratio AFM determined by the characteristic map 71 and processed via the first correction circuit 73 in FIG. 2. Referring further to FIG. 2, the second correction value K is updated by the second correction value updating circuit 72*b* and fed to the second correction circuit 74. Further, the second correction circuit 74 receives the target air-fuel ratio AFM from the first correction circuit 73 to convert the received target air-fuel ratio AFM to the corresponding target output value ILM of the lean mixture sensor 23 using the characteristic map 79. Subsequently, the second correction circuit 74 corrects the target output value ILM with the second correction value K as expressed by the following equation:

$$ILM \leftarrow K \cdot ILM$$

The second correction circuit 74 further converts the target output value ILM as corrected by the second correction value K to the corresponding target air-fuel ratio AFM using the characteristic map 79, and then supplies this converted target air-fuel ratio AFM to the comparator circuit 76 for comparison with the actual air-fuel ratio AFR.

Specifically, when answer at the step 180 is NO, it is determined that the surging detected at the step 140 was caused due to variation in the output characteristic of the lean mixture sensor 23 and not due to the lowering of the lean limit or the surging limit of the engine 1. Accordingly, the second correction circuit 74 corrects the target air-fuel ratio AFM received from the first correction circuit 73 based on the second correction value K only when the lean burn control is performed under the feedback control. As a result, the corrected target air-fuel ratio AFM as corrected by the second correction value K is used only in the lean burn feedback control.

Figure 8:
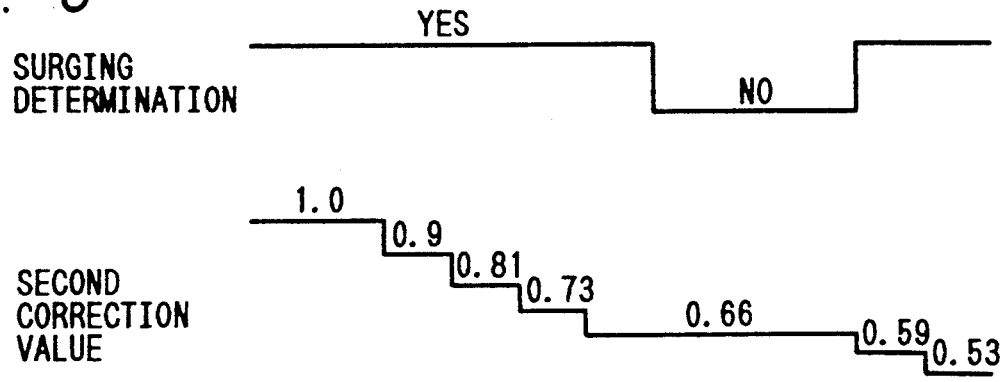
FIG. 8 is an explanatory view for showing a manner of correction of the second correction value.

The second correction value K is initially set to a value "1", and then updated to decrease stepwise every time the step 200 is executed as shown in FIG. 8 until answer at the step 140 becomes NO, i.e. until the second correction value is decreased to 0.66 in FIG. 8 where no surging is detected at the step 140.

Figure 7A:
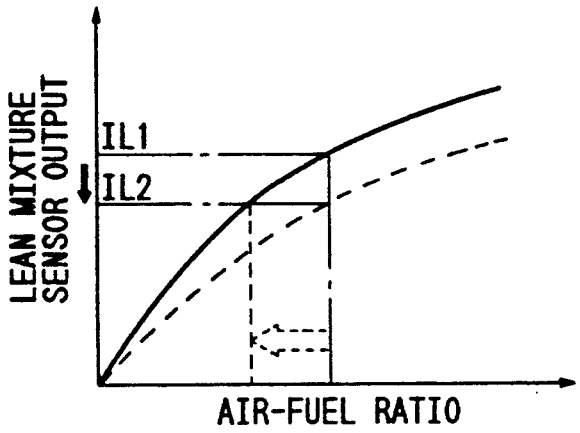
FIG. 7(A) is an explanatory view for showing variation in output characteristic of the lean mixture sensor.
Figure 7B:
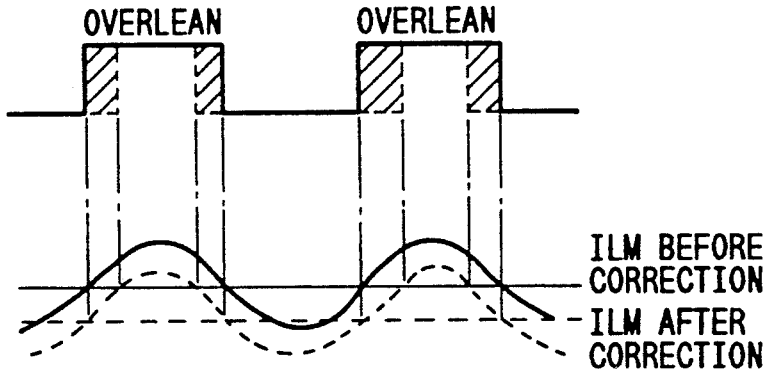
FIG. 7(B) is an explanatory view for showing effect of the correction of a target output value of the lean mixture sensor.

Effect of the correction of the target air-fuel ratio AFM using the second correction value K will be explained with reference to FIGS. 7(A) and 7(B). When the output characteristic of the lean mixture sensor 23 is varied due to deterioration of the lean mixture sensor itself or environmental variation, such as, running on the highlands, the output signal level of the lean mixture sensor 23 tends to be lowered from a solid line to a dotted line in FIG. 7(A). Accordingly, the detected output value of the lean mixture sensor 23 is lowered from IL1 to IL2. As a result, when the output value IL2 is used to derive the actual air-fuel ratio AFR based on the characteristic map 79, the actual air-fuel ratio AFR is derived to be smaller, i.e. richer than a real value, so that the air-fuel ratio of the air-fuel mixture gas supplied to the engine is controlled to be larger, i.e. leaner than the target value in the feedback control to cause the surging in the engine. In order to compensate for this dropping of the output level, the second correction value K is updated to decrease for reducing the target output value ILM of the lean mixture sensor 23 so as to make smaller the corresponding target air-fuel ratio AFM which is then fed to the comparator circuit 76 for comparison with the monitored air-fuel ratio AFR. As a result, the air-fuel ratio of the air-fuel mixture gas is controlled to the target air-fuel ratio AFM as determined by the characteristic map 71 and processed by the first correction circuit 73. As shown in FIG. 7(B), hatched areas are not determined as overlean with respect to the target output value ILM before the correction. In FIG. 7(B), a solid waveform line represents an output signal of the lean mixture sensor 23 with no output characteristic variation being generated, while a dotted waveform line represents an output signal of the lean mixture sensor 23 with the output characteristic variation being generated.

The stepwise correction of the second correction value K is required for preventing the corrected target output value ILM or the corrected target air-fuel ratio AFM from decreasing largely beyond the variation in the lean mixture sensor output characteristic. Specifically, as in case of the stepwise updating of the first correction value Δ AFM, the variation of the lean mixture sensor output characteristic is caused by various factors so that it is uncertain to what extent the output level of the lean mixture sensor 23 is lowered. As the first correction value Δ AFM, the second correction value K updated at the step 200 is fixed until it is updated in a next execution of the step 200.

In this preferred embodiment, the second correction circuit 74 first corrects the target output value ILM of the lean mixture sensor 23 and then converts the corrected target output value ILM to the corresponding target air-fuel ratio AFM. This is preferable since the correction by the second correction value K is for compensating the variation in the output characteristic of the lean mixture sensor 23, meaning that the follow-up to the output characteristic variation can be more facilitated by correcting the target output value ILM than by directly correcting the target air-fuel ratio AFM. However, it may be arranged to directly correct the target air-fuel ratio AFM. Further, in this preferred embodiment, since the output of the lean mixture sensor 23 is converted to a voltage signal via the current-to-voltage converter 504 as described before, the target output value ILM is in the form of a target voltage value corresponding to a target current value of the lean mixture sensor 23. However, it may be arranged that the target output value ILM is in the form a target current value.

As appreciated from the foregoing description, in this preferred embodiment, the first correction value Δ AFM is updated by the first correction value updating circuit 72*a* when the surging detected in the lean burn feedback control is lasting after having shifted to the open loop control, while the second correction value K is updated by the second correction value updating circuit 72*b* when the surging detected in the lean burn feedback control is stopped after having shifted to the open loop control. The first correction circuit 73 corrects the target air-fuel ratio by the first correction value ΔAFM (equal to or greater than a value "0") irrespective of whether the lean burn control is under the open loop control or the feedback control. On the other hand, the second correction circuit 74 corrects the target air-fuel ratio supplied from the first correction circuit 73 based on the second correction value K (equal to or smaller than a value "1") only when the lean burn control is under the feedback control. Accordingly, the target air-fuel ratio as processed via the first correction circuit 73 is used in the open loop control, while the target air-fuel ratio as processed via the first and second correction circuits 73 and 74 is used in the feedback control. As a result, the second correction value K which is for compensating the variation in the output characteristic of the lean mixture sensor 23 is prevented from affecting the target air-fuel ratio to be used in the open loop control so that the lean burn control is properly executed either in the open loop control and in the feedback control.

The first correction value Δ AFM and the second correction value K may be initialized when the ECU 50 is first powered on. This means that, since particularly the variation in the output characteristic of the lean mixture sensor 23 is likely to be caused due to the environmental variation, particularly the second correction value K is useless when the environmental condition is changed. However, the first and second correction values may be stored in such as a backup RAM so as to be used in a future lean burn control since the lowering of the lean limit of the engine and the variation in the output characteristic of the lean mixture sensor may be also caused by aged deterioration of the engine and the lean mixture sensor themselves.

It may further be arranged to execute an updating routine once at the engine start-up for setting the maximum target air-fuel ratio and the maximum target output value of the lean mixture sensor. Specifically, the target air-fuel ratio and the target output value of the lean mixture sensor are increased stepwise until the surging is detected, so as to set the maximum values thereof for controlling the air-fuel ratio of the air-fuel mixture gas as lean as possible in the lean burn control. In this case, a preset limit target air-fuel ratio and a preset limit target output value of the lean mixture sensor may be used as guard values.

Further, it may be arranged to increase the second correction value K stepwise after the surging detected at the step 140 in FIG. 3 has been eliminated by decreasing the second correction value K, so as to converge the second correction value K to an optimum value.

It is to be understood that this invention is not to be limited to the preferred embodiments and modifications described above, and that various changes and modifications may be made without departing from the spirit and scope of the invention as defined in the appended claims.

For example, although the speed density type fuel injection system has been described in the foregoing preferred embodiment, the present invention may also be applied to the mass flow type fuel injection system. Further, the surging may be detected based on monitored engine speed variation or others. In addition, a cylinder pressure sensor or a combustion light sensor may be utilized in place of the lean mixture sensor for monitoring the air-fuel ratio based on a monitored pressure in the engine cylinder or a monitored frequency of a combustion light in the engine cylinder, respectively.

What is claimed is:

1. A lean burn control system for an internal combustion engine having a first operation mode in which an air-fuel ratio of the air-fuel mixture gas is controlled by a target air-fuel ratio indicative value in an open loop control and a second operation mode in which an air-fuel ratio of the air-fuel mixture gas is controlled by a target air-fuel ratio indicative value in a feedback control, said lean burn control system comprising:

means for detecting occurrence of surging in the engine in said second operation mode;

means for halting said second operation mode when the surging is detected by said surging detecting means;

means for determining whether the surging is lasting or stopped after said second operation mode is halted by said halting means;

first updating means for updating a first correction value for said target air-fuel ratio indicative value when said determining means determines that the surging is lasting, said first updating means updating said first correction value so as to eliminate the surging detected in said second operation mode;

second updating means for updating a second correction value for said target air-fuel ratio indicative value when said determining means determines that the surging is stopped, said second updating means updating said second correction value so as to eliminate the surging detected in said second operation mode;

first correction means for correcting said target air-fuel ratio indicative value based on said first correction value, said first correction means correcting said target air-fuel ratio indicative value in either of said first and second operation modes; and second correction means for correcting said target air-fuel ratio indicative value based on said second correction value, said second correction means correcting said target air-fuel ratio indicative value only in said second operation mode.

2. The lean burn control system as set forth in claim 1, wherein said first updating means updates said first correction value in a stepwise fashion.

3. The lean burn control system as set forth in claim 1, wherein said second updating means updates said second correction value in a stepwise fashion.

4. The lean burn control system as set forth in claim 1, wherein said determining means performs said determination by detecting occurrence of the surging after said second operation mode is halted by said halting means.

5. A lean burn control system for an internal combustion engine, comprising:

sensor means for monitoring a preselected component contained in exhaust gas to produce an air-fuel ratio indicative signal;

means for setting a target air-fuel ratio indicative value;

open loop control means for controlling an air-fuel ratio of air-fuel mixture gas to be fed to the engine based on said target air-fuel ratio indicative value in an open loop control;

feedback control means for controlling an air-fuel ratio of air-fuel mixture gas to be fed to the engine based on said air-fuel ratio indicative signal and said target air-fuel ratio indicative value in a feedback control;

means for detecting occurrence of surging in the engine in said feedback control;

means for executing selection between said open loop control and said feedback control, said selection means halting said feedback control to select said open loop control when the surging is detected by said surging detecting means;

means for determining whether the surging is lasting or stopped after said feedback control is halted by said selection means;

first updating means for updating a correction value for said target air-fuel ratio indicative value when said determining means determines that the surging is lasting, said first updating means updating said correction value so as to eliminate the surging detected in said feedback control;

first correction means for correcting said target air-fuel ratio indicative value based on said correction value, said first correction means correcting said target air-fuel ratio indicative value in either of said open loop control and said feedback control to provide a first corrected target air-fuel ratio indicative value;

second updating means for updating a correction value for said first corrected target air-fuel ratio indicative value when said determining means determines that the surging is stopped, said second updating means updating said correction value for said first corrected target air-fuel ratio indicative value so as to eliminate the surging detected in said feedback control; and second correction means for correcting said first corrected target air-fuel ratio indicative value based on said correction value for said first corrected target air-fuel ratio indicative value, said second correction means correcting said first corrected target air-fuel ratio indicative value in said feedback control to provide a second corrected target air-fuel ratio indicative value, whereby said open loop control means controls the air-fuel ratio of the air-fuel mixture gas based on said first corrected target air-fuel ratio indicative value, while said feedback control means controls the air-fuel ratio of the air-fuel mixture gas based on said air-fuel ratio indicative signal and said second corrected target air-fuel ratio indicative value.

6. The lean burn control system as set forth in claim 5, wherein said determining means performs said determination after a lapse of a predetermined time from a time point when said feedback control is halted by said selection means, said predetermined time being set to a duration required for said open loop control to become stable after switched from said feedback control.

7. The lean burn control system as set forth in claim 5, wherein said surging detecting means includes means for deriving a variation in said air-fuel ratio indicative signal and means for determining occurrence of the surging when said variation is greater than a predetermined value.

8. The lean burn control system as set forth in claim 7, wherein said variation represents a cumulative value of unit interval variations in said air-fuel ratio indicative signal over a predetermined time period.

9. The lean burn control system as set forth in claim 5, wherein said second correction means derives said second corrected target air-fuel ratio indicative value by multiplying said correction value for said first corrected target air-fuel ratio indicative value by a first target output value of said sensor means to derive a second target output value thereof and by converting said second target output value to a corresponding target air-fuel ratio indicative value which represents said second corrected target air-fuel ratio indicative value, said first target output value corresponding to said first corrected target air-fuel ratio indicative value.

10. The lean burn control system as set forth in claim 9, wherein said correction value for said first corrected target air-fuel ratio indicative value takes a value equal to or less than a value "1".

11. The lean burn control system as set forth in claim 5, wherein said first updating means increases said correction value for said target air-fuel ratio indicative value by a unit value every time the surging is detected by said surging detecting means and said determining means determines that the surging is lasting, and said first correction means derives said first corrected target air-fuel ratio indicative value by subtracting said correction value for said target air-fuel ratio indicative value from said target air-fuel ratio indicative value.

* * * * *